US007083883B2

(12) United States Patent
Kim et al.

(10) Patent No.: US 7,083,883 B2
(45) Date of Patent: Aug. 1, 2006

(54) POLYMER HAVING STILBENQUINONE STRUCTURE AND ELECTROPHOTOGRAPHIC PHOTORECEPTOR CONTAINING THE SAME

(75) Inventors: Beom-Jun Kim, Gyeonggi-do (KR); Saburo Yokota, Gyeonggi-do (KR); Kyung-yol Yon, Gyeonggi-do (KR); Hwan-koo Lee, Gyeonggi-do (KR)

(73) Assignee: Samsung Electronics Co., Ltd., Suwon-si (JP)

( * ) Notice: Subject to any disclaimer, the term of this patent is extended or adjusted under 35 U.S.C. 154(b) by 208 days.

(21) Appl. No.: 10/687,667

(22) Filed: Oct. 20, 2003

(65) Prior Publication Data

US 2004/0096762 A1 May 20, 2004

(30) Foreign Application Priority Data

Nov. 18, 2002 (KR) ..... 10-2002-0071607

(51) Int. Cl.
*G03G 5/47* (2006.01)

(52) U.S. Cl. ..... 430/58.25; 430/96; 399/159; 552/304

(58) Field of Classification Search ..... 399/159; 552/304; 430/58.25, 96
See application file for complete search history.

(56) References Cited

U.S. PATENT DOCUMENTS

| | | | | |
|---|---|---|---|---|
| 3,397,086 | A | 8/1968 | Bartfai | |
| 3,484,237 | A | 12/1969 | Shattuck et al. | |
| 3,615,414 | A | 10/1971 | Light | |
| 5,013,623 | A | 5/1991 | Itoh et al. | |
| 5,176,976 | A * | 1/1993 | Kikuchi et al. | 430/58.25 |
| 6,228,546 | B1 | 5/2001 | Kashizaki et al. | |
| 6,573,017 | B1 * | 6/2003 | Azuma et al. | 430/96 |

FOREIGN PATENT DOCUMENTS

| | | |
|---|---|---|
| JP | 54-001633 | 1/1979 |

* cited by examiner

*Primary Examiner*—Mark A. Chapman
(74) *Attorney, Agent, or Firm*—Staas & Halsey LLP

(57) ABSTRACT

A polymer has stilbenquinone structures as a repetitive unit and an electrophotographic photoreceptor containing the polymer. More particularly, the polymer has an improved electro-transporting capacity in that precipitation does not occur even when the polymer is used as an electron transporter for an electrophotographic photoreceptor in a high concentration.

54 Claims, 2 Drawing Sheets

POLYMER HAVING STILBENQUINONE STRUCTURE AND ELECTROPHOTOGRAPHIC PHOTORECEPTOR CONTAINING THE SAME

CROSS-REFERENCE TO RELATED APPLICATIONS

This application claims the benefit of Korean Application No. 10-2002-71607, filed Nov. 18, 2002, in the Korean Intellectual Property Office, the disclosure of which is incorporated herein by reference.

BACKGROUND OF THE INVENTION

1. Field of the Invention

The invention relates to a polymer having stilbenquinone structures as a repetitive unit and an electrophotographic photoreceptor containing the same. More particularly, the invention relates to a polymer with an improved electrotransporting capacity, in that precipitation does not occur even when used as an electron transporter for an electrophotographic photoreceptor in a high concentration, and an electrophotographic photoreceptor containing the polymer.

2. Description of the Related Art

Generally, an electrophotographic photoreceptor is produced by forming a photosensitive layer containing a charge generating material, a charge transporting material and a binder resin on an electroconductive substrate. Typically, a laminated-type photoreceptor with separate functional layers is used, in which a charge transporting material and a charge generating material are laminated to produce a photosensitive layer.

Recently, however, there have been active research and developments on single layered photoreceptors, which have the advantages of having a simple production process and having positive chargeability available to a positive corona discharging, which is a weak ozone producing mechanism.

Examples of single layered photoreceptors are a photoreceptor containing PVK/TNF charge transporting complex as disclosed in U.S. Pat. No. 3,484,237, a photoreceptor containing photoconductive phthalocyanine as disclosed in U.S. Pat. No. 3,397,086 and a photoreceptor which contains thiapyrylium dye salt and a charge transporting material as disclosed in U.S. Pat. No. 3,615,414. However, such photoreceptors are not presently used because the photoreceptors have disadvantages of unsatisfactory electrostatic characteristics, restrictive selection of suitable materials, and toxicity of materials.

Most of the widely used single layered photoreceptors have a photosensitive layer produced by dispersing a charge generating material disclosed in Japanese Laid-Open Publication 54-1633, a hole transporting material and a electron transporting material in a binder resin. Such a photoreceptor has the advantage of allowing a wide selection of materials because of the separation of functions between the charge generating material and the charge transporting material. Also, the charge generating material may be used in a low concentration, helping to enhance the functional and the chemical stability of the photoreceptor.

However, because the electron transporting material used for the aforementioned photoreceptor is ordinarily a monomolecular material, such as diphenoquinone of Chemical Formula I or stilbenquinone of Chemical Formula II, high concentrations of the materials are necessary to obtain a high electron transportability. These monomolecular electron transporting materials have limited solubility in a binder resin, and thus form precipitates which are deposited on the film during a film forming process.

Chemical Formula I

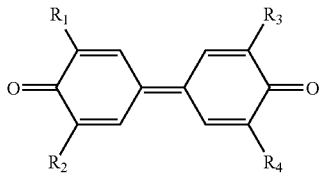

Chemical Formula II

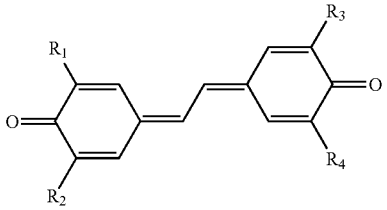

In an attempt to overcome the foregoing problems, U.S. Pat. No. 6,228,546B1 disclosed a polymer with a diphenoquinone structure as a repetitive unit as represented by Chemical Formula III.

Chemical Formula III

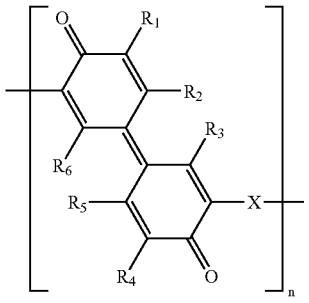

However, in order to synthesize the polymer of Chemical Formula III, a high priced catalyst and reactants such as Fetizon reagent are used, thus, depreciating the cost efficiency. Also, it is difficult to obtain a polymer with a high molecular weight due to side reactions of the materials.

SUMMARY OF THE INVENTION

An aspect of the present invention is to provide a polymer with an enhanced solubility in a binder resin so that even when the polymer is used in a high concentration, precipitation of crystals does not occur, thus improving the electrotransportability.

Another aspect of the invention is to provide an electrophotographic photoreceptor having the polymer.

In one aspect, the polymer of the present invention is represented by Chemical Formula 1.

Chemical Formula 1

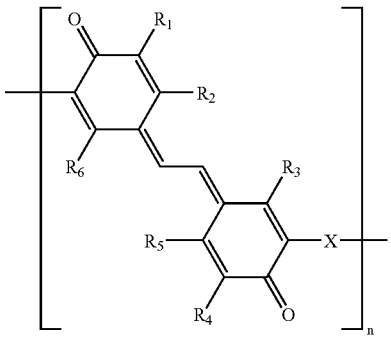

wherein $R_1$, $R_2$, $R_3$, $R_4$, $R_5$, and $R_6$ each independently is selected from the group consisting of a hydrogen atom, a halogen atom, a hydroxy group, a carboxyl group, a cyano group, an amino group, a nitro group, an optionally substituted alkyl group with 1 to 20 carbon atoms, an optionally substituted aryl group with 6 to 30 carbon atoms, an optionally substituted arylalkyl group with 7 to 30 carbon atoms, and an optionally substituted alkoxy group with 1 to 20 carbon atoms; —X— represents a single bond, —S—, —O—, —NH—, an optionally substituted alkylene group with 1 to 20 carbon atoms, an optionally substituted heteroalkylene group with 1 to 20 carbon atoms, an optionally substituted alkenylene group with 2 to 20 carbon atoms, an optionally substituted heteroalkenylene group with 2 to 20 carbon atoms, an optionally substituted arylene group with 6 to 30 carbon atoms, and an optionally substituted arylalkylene group with 7 to 30 carbon atoms; and n represents an integer of 5 to 1,000.

In another aspect, the invention provides an electrophotographic photoreceptor, including a substrate, and a photosensitive layer disposed on the substrate, wherein the photosensitive layer includes the polymer of Chemical Formula 1.

In still another aspect, the invention provides an electrophotographic photoreceptor, including a substrate, a photosensitive layer, and an intermediate layer disposed between the substrate and the photosensitive layer, wherein the intermediate layer comprises the polymer of the Chemical Formula 1.

In still another aspect, where the intermediate layer is a conductive layer, a barrier layer may be formed between the substrate and the conductive layer.

The electrophotographic photoreceptor may be implemented in an electrophotographic cartridge, an electrophotographic drum and/or an image forming apparatus.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
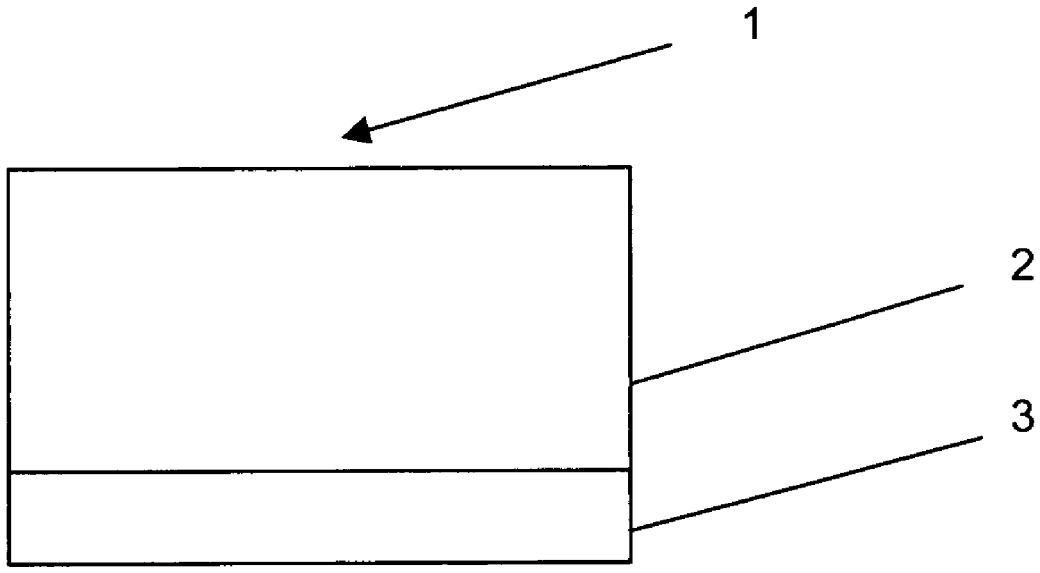
FIG. 1 is a block diagram (not to scale) illustrating an electrophotographic photoreceptor comprising a photosensitive layer installed on a conductive substrate in accordance with an embodiment of the present invention.

The invention is described more fully below, in which preferred embodiments of the invention are shown. The invention may, however, be embodied in many different forms and should not be construed as being limited to the embodiments set forth herein; rather, the embodiments are provided so that the disclosure will be thorough and complete, and will fully convey the concept of the invention to those skilled in the art.

The polymer of the invention is represented by Chemical Formula 1,

Chemical Formula 1

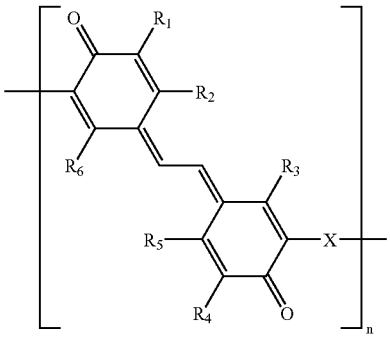

wherein $R_1$, $R_2$, $R_3$, $R_4$, $R_5$, and $R_6$each independently is selected from the group consisting of a hydrogen atom, a halogen atom, a hydroxy group, a carboxyl group, a cyano group, an amino group, a nitro group, an optionally substituted alkyl group with 1 to 20 carbon atoms, an optionally substituted aryl group with 6 to 30 carbon atoms, an optionally substituted arylalkyl group with 7 to 30 carbon atoms, and an optionally substituted alkoxy group with 1 to 20 carbon atoms; —X— represents a single bond, —S—, —O—, —NH—, an optionally substituted alkylene group with 1 to 20 carbon atoms, an optionally substituted heteroalkylene group with 1 to 20 carbon atoms, an optionally substituted alkenylene group with 2 to 20 carbon atoms, an optionally substituted heteroalkenylene group with 2 to 20 carbon atoms, an optionally substituted arylene group with 6 to 30 carbon atoms, and an optionally substituted arylalkylene group with 7 to 30 carbon atoms; and n represents an integer of 5 to 1,000.

It is preferable that —X— in the Chemical Formula 1 is a single bond, or —O—; $R_1$ and $R_4$ each independently are selected from the group consisting of a hydrogen atom and an optionally substituted alkylene group with 1 to 12 carbon atoms; and $R_2$, $R_3$, $R_5$ and $R_6$ each independently are a hydrogen atom.

Because the polymer of Chemical Formula 1 exists as a mixture of low molecular weight masses and high molecular weight masses, the crystallization condition is more complicated than monomolecular materials. Therefore, unlike monomolecular materials, precipitation of crystal is rare even when the polymer is used in a high concentration, and thus, the electron transporting ability is enhanced.

The polymer of Chemical Formula 1 is prepared by refluxing methylenebisphenol in an organic solvent in the presence of an oxidizing agent for 5 to 48 hours.

The oxidizing agent is not particularly limited to predetermined materials as long as the oxidizing agent effectively oxidizes phenol to produce stilbenequinone. Examples of oxidizing agents include manganese dioxide, chromic acid and permanganic acid.

It is preferable that a halogenated solvent is used as the organic solvent. Examples of solvents include chloroform, dichloromethane, and dichloroethane.

Preferably, the average molecular weight of the polymer of Chemical Formula 1 is 500 to 100,000.

Various embodiments of the polymer of Chemical Formula 1 are represented by Chemical Formulas 2 to 36, in which n is an integer of 5 to 1000, but the scope of the invention is not limited to the below listed embodiments.

Chemical Formula 2

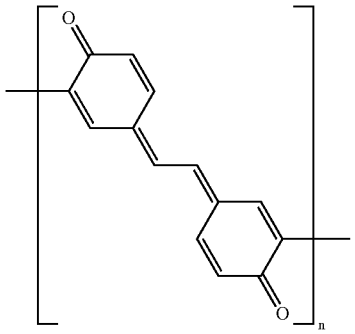

Chemical Formula 3

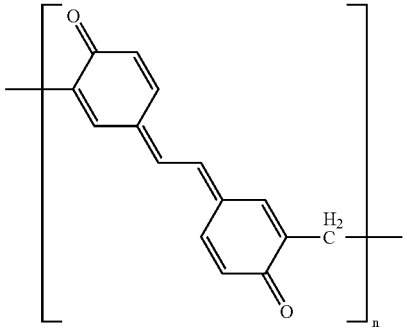

-continued

Chemical Formula 4

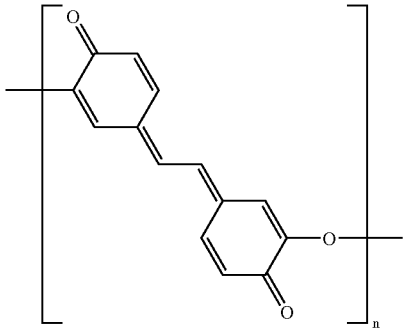

Chemical Formula 5

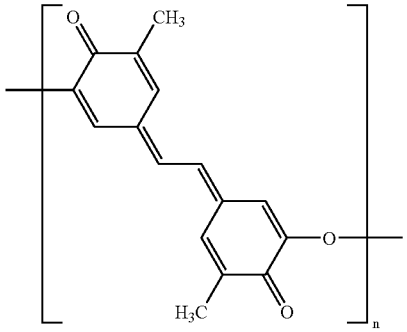

Chemical Formula 7

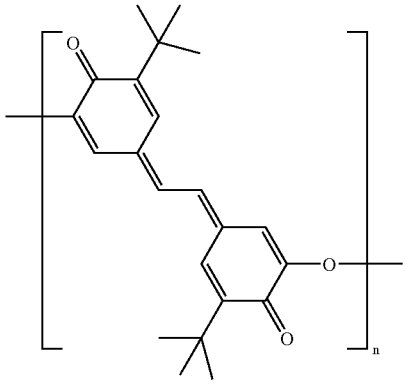

Chemical Formula 8

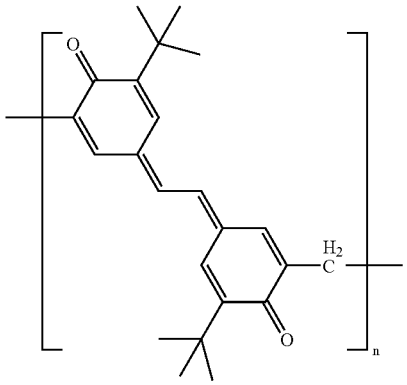

-continued
Chemical Formula 9
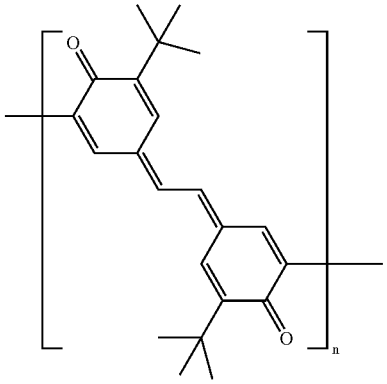
Chemical Formula 10
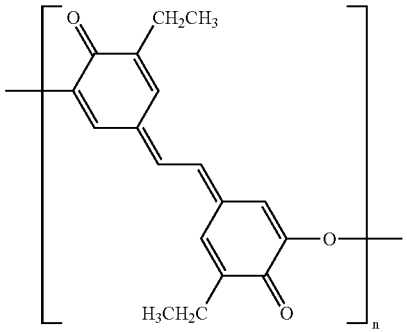
Chemical Formula 11
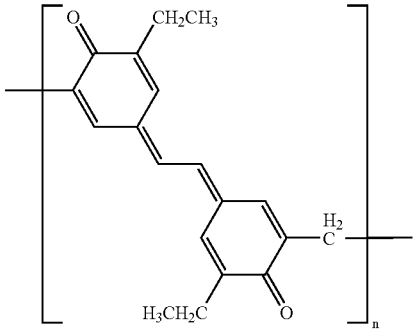
Chemical Formula 12
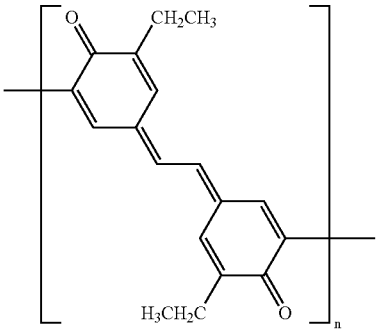
-continued
Chemical Formula 13
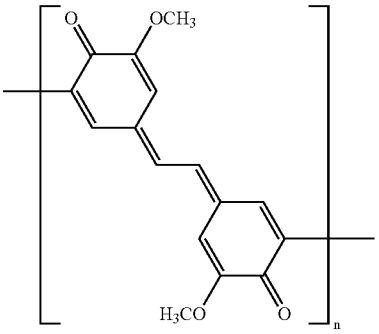
Chemical Formula 14
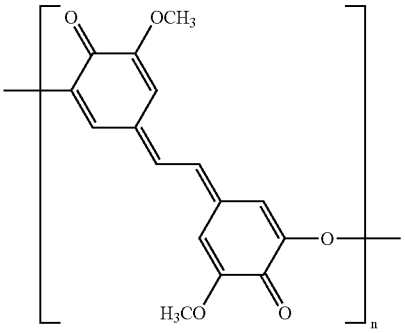
Chemical Formula 15
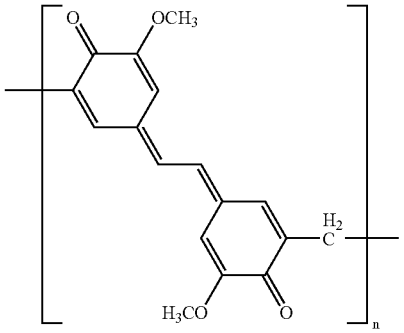
Chemical Formula 16
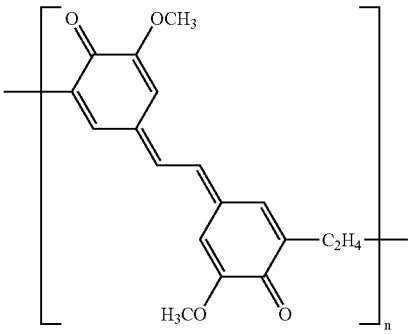

-continued
Chemical Formula 17
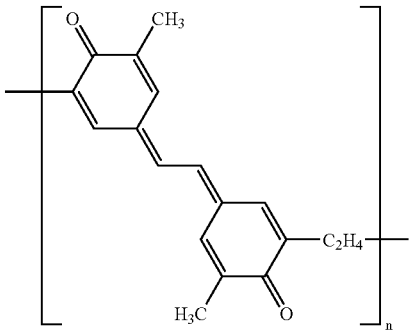
Chemical Formula 18
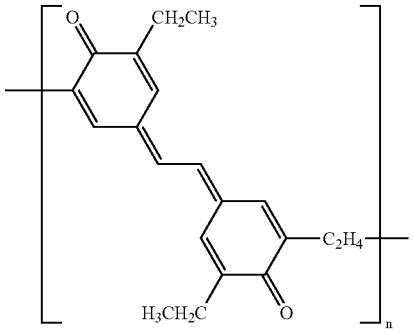
Chemical Formula 19
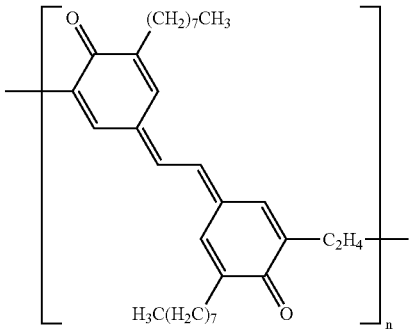
Chemical Formula 20
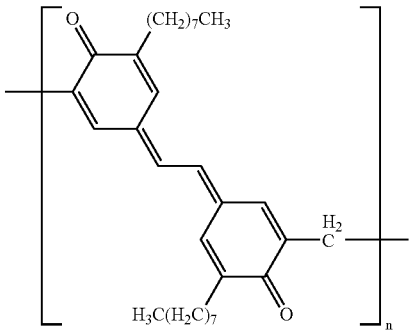
-continued
Chemical Formula 21
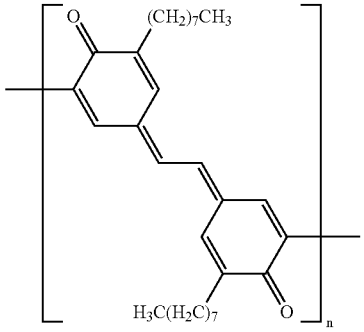
Chemical Formula 22
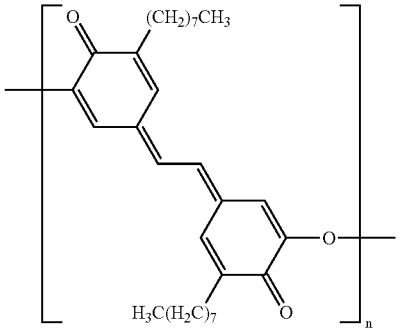
Chemical Formula 23
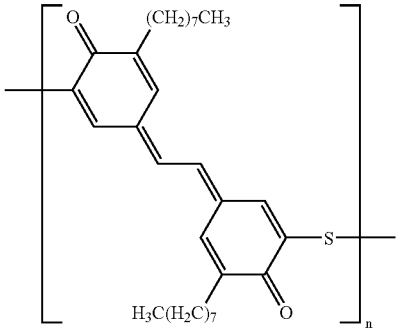
Chemical Formula 24
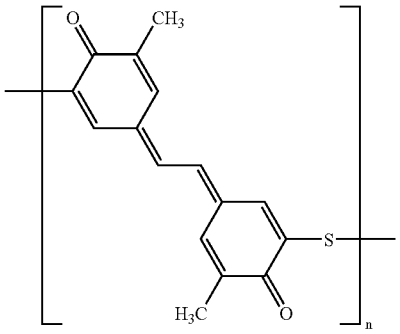

-continued
Chemical Formula 25
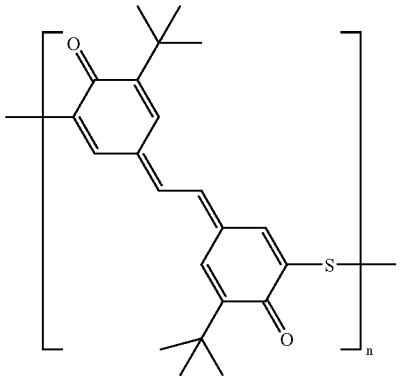
Chemical Formula 26
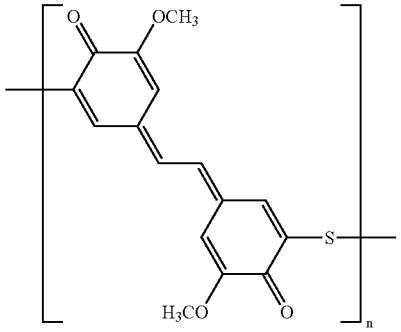
Chemical Formula 27
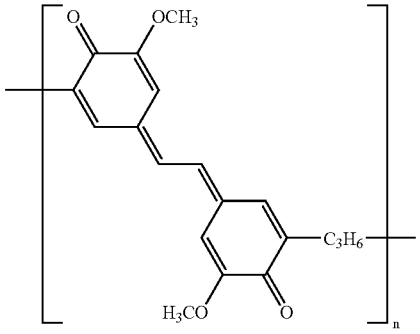
Chemical Formula 28
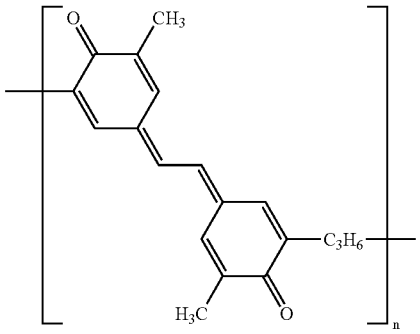
-continued
Chemical Formula 29
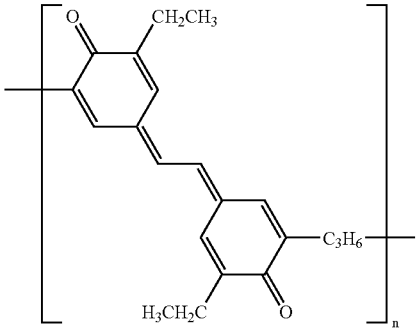
Chemical Formula 30
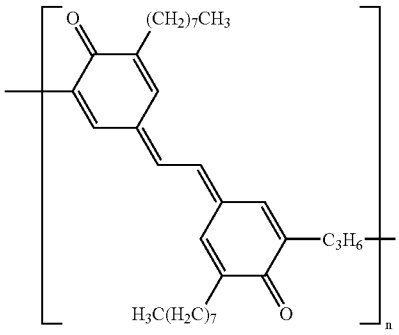
Chemical Formula 31
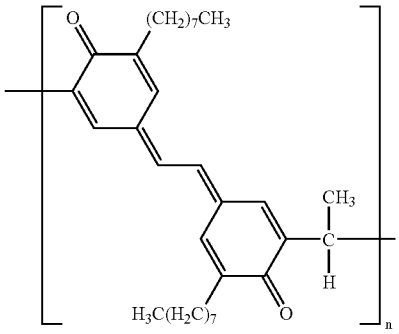
Chemical Formula 32
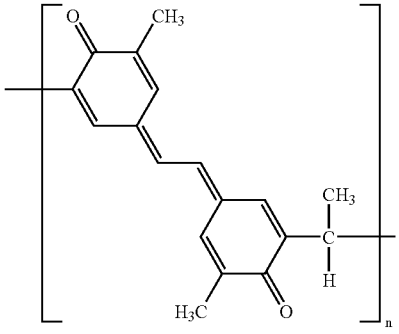

-continued

Chemical Formula 33

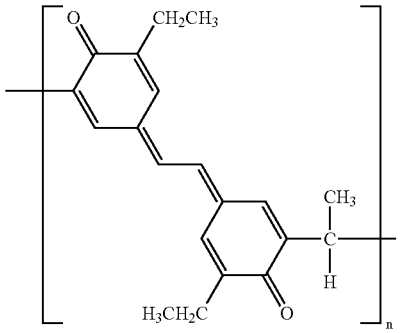

Chemical Formula 34

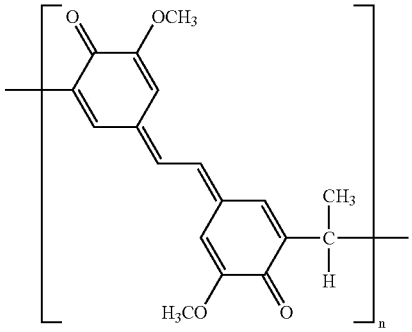

Chemical Formula 35

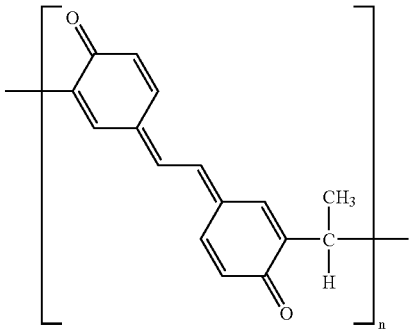

Chemical Formula 36

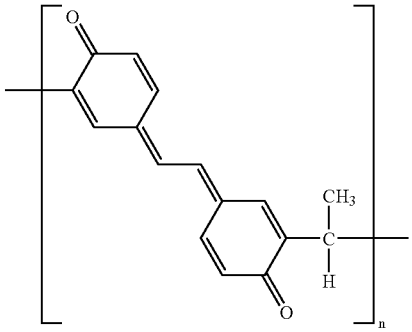

An electrophotographic photoreceptor is produced by applying a photosensitive layer on an electroconductive substrate. Metallic or plastic materials in a shape of a drum or a belt are often used as the electroconductive substrate.

The photosensitive layer may be categorized into two groups: a laminated type layer or a single layered type. A laminated type photosensitive layer includes a charge generating layer containing a charge generating material, and a charge transporting layer containing a charge transporting material. A single layered type photosensitive layer includes both the charge generating material and the charge transporting material within the same layer.

The polymer of Chemical Formula 1 functions as a charge transporting material or preferably, as an electron transporting material. Accordingly, in a laminated type photosensitive layer, the polymer is included in the charge transporting layer, whereas, in a single layered type photosensitive layer, the polymer is used along with the charge generating material.

Examples of suitable charge generating materials include an organic compound such as pthalocyanine pigments, azo pigments, quinone pigments, perylene pigments, indigo pigments, bisbenzoimidazole pigments, quinacridone pigments, azulenium dye, squarilium dye, pyrylium dye, triarylmethane dye and cyanine dye, and an inorganic compound such as amorphous silicon, amorphous selenium, trigonal selenium, tellurium, selenium-tellurium alloys, cadmium sulphide, antimone sulfide, and zinc sulfide. The charge generating material is not limited to the foregoing specified materials and the materials may be used alone or in a combination.

In a laminated type photosensitive layer, the aforementioned charge generating material is dissolved in a solvent with a binder resin to form a film on an electroconductive substrate by a conventional method including coating, vacuum deposition, sputtering and chemical vapor deposition (CVD) to form a charge generating layer. Typically, the thickness of the charge generating layer is 0.1 μm to 1.0 μm.

Preferably, the binder resin used with the charge generating material is an electrically insulating polymer. Examples include polycarbonate, polyester, methacrylic resin, acryl resin, polyvinylchloride, polyvinylidene chloride, polystyrene, polyvinylacetate, silicon resin, silicon-alkyd resin, styrene-alkyd resin, poly-N-vinylcarbazole, phenoxy resin, epoxy resin, polyvinyl butyral, polyvinyl acetal, polyvinyl formal, polysulfone, polyvinyl alcohol, ethylcellulose, phenol resin, polyamide, carboxymethyl cellulose and polyurethane, but are not limited to the examples specified. The materials may be used alone or in a combination.

In forming a laminated type photosensitive layer, a charge transporting layer having the polymer of Chemical Formula 1 is formed on the charge generating layer. However, the order of the layers may be reversed to form the charge generating layer on the charge transporting layer. To produce the charge transporting layer, a solution containing the polymer of Chemical Formula 1 and a binder resin in a solvent is used.

The single layered type photosensitive layer is made from a solution containing a charge generating material, a charge transporting material, a binder resin and a solvent.

In the present invention, the polymer of Chemical Formula 1 is used as the charge transporting material. It is also preferable that a combination of the polymer of Chemical Formula 1 with other charge transporting materials is used as the charge transporting material.

The other charge transporting material may be either a hole transporting material or an electron transporting material, and in particular, is preferably an electron transporting material for a single layered type photoreceptor.

Examples of the hole transporting material include nitrogen containing cyclic compounds and condensed polycyclic compounds such as pyrenes, hydrazones, oxazoles, oxadiazoles, pyrazolines, arylamines, arylmethanes, benzidines, tiazoles and styryls. Polymer compounds or polysilanes having the foregoing substituents in the main chain or the side chain may be used. The hole transporting material is not limited to the foregoing examples, and the hole transporting materials may be used alone or in a combination.

Examples of the electron transporting materials include electron-absorbing low molecular weight molecules such as benzoquinones, cyanoethylenes, cyanoquinodimethanes, fluorenones, xanthones, phenanthraquinone, phthalic acid anhydrides, thiopyrans and diphenoquinones, but are not limited to the foregoing specified materials, and may be used alone or in a combination. Electron transporting polymers or pigments with n-type semiconductor characteristics are good examples as well.

The thickness of the photosensitive layer is typically 5 μm to 50 μm for both single layered type and laminated type photosensitive layers. Examples of solvents used in the coating process include organic solvents such as alcohols, ketones, amides, ethers, esters, sulfones, aromatics and aliphatic hydrocarbon halide solvents. Methods of coating include dip coating, ring coating, roll coating and spray coating, and for the present invention, any suitable methods may be used.

Preferably, the ratio of a charge transporting material and a binding resin is 1:0.5 to 1:2. If the ratio of the charge transporting material and the binding resin is less than 1:0.5, the mechanical strength of the photosensitive layer may be affected. But if the ratio is greater than 1:2, the charge transportability is insufficient, leading to a deficient sensitivity, thus resulting in a high residual charge.

A conductive layer may be further formed between the substrate and the photosensitive layer. The conductive layer suppresses the formation of an interface band and cures defects, if any, on a substrate. The conductive layer is formed by dispersing a conductive powder such as carbon black, graphite, metal powder or metal oxide powder in a solvent, coating the substrate with the resulting dispersion, and drying the resulting structure. Preferably, the thickness of the conductive layer is 5 μm to 50 μm.

Further, a barrier layer may be formed between the substrate and the photosensitive layer or between the substrate and the conductive layer to enhance adhesion, or to obstruct charge injection from the substrate to the photosensitive layer. The barrier layer may be, for example, an anodized surface layer of aluminum, a layer of a mixture containing resin and metallic oxide powders such as titanium oxide and tin oxide, or resin layers such as polyvinyl alcohol, casein, ethyl cellulose, gelatin, phenol resin and polyamides, but the barrier layer is not limited to the foregoing specified materials. A preferable thickness of the barrier layer is 0.05 μm to 5 μm.

Also, other additives such as a plasticizer, a leveling agent, a dispersing stabilizer, an antioxidant and a photostabilizer may be used with the binder resin.

Examples of the antioxidant include antioxidants derived from phenols, sulfurs, phosphors or amines.

Examples of the photostabilizer include benzotriazole compounds, benzophenone compounds and hindered amine compounds.

The polymer of Chemical Formula 1 may be used not only for copy machines, but also for other printing machines such as a laser printer, a CRT printer, an LED printer, a liquid crystal printer, and a laser electronic photographer.

The alkyl group, as a substituent for the polymer of Chemical Formula 1, refers to a linear or a branched radical with 1 to 20 carbon atoms, preferably, a linear or a branched radical with 1 to 12 carbon atoms, more preferably with 1 to 8 carbon atoms. Examples of the radical include methyl, ethyl, n-propyl, isopropyl, n-butyl, isobutyl, sec-butyl, t-butyl, pentyl, isoamyl, hexyl and octyl. One or more hydrogen atoms in the alkyl group may be substituted with one or more of halogen atoms such as fluoro, chloro or bromo to form fluoromethyl, chloroethyl, and the like.

The alkoxy group, as a substituent for the polymer of Chemical Formula 1, refers to a linear or a branched, oxygen-containing radical with alkyl moiety having 1 to 20 carbon atoms. It is preferable that a lower alkoxy radical with 1 to 6 carbon atoms is used. Examples include methoxy, ethoxy, propoxy, butoxy and t-butoxy. It is more preferable that a lower alkoxy radical with 1 to 4 carbon atoms is used. One or more hydrogen atoms in the alkoxy group may be substituted with one or more halogen atoms such as fluoro, chloro or bromo to form a haloalkoxy radical. It is preferable that a lower haloalkoxy radical with 1 to 3 carbon atoms is used. Examples of the lower haloalkoxy radical include fluoromethoxy, chloromethoxy, trifluoromethoxy, trifluoroethoxy, fluoroethoxy and fluoropropoxy.

The aryl group, as a substituent for the polymer of Chemical Formula 1, refers to a cyclic aromatic hydrocarbon with 6 to 30 carbon atoms in one or more ring structures, and may be used solely or in a combination. The rings may be held together by a pendant method or fused together. The term "aryl" includes phenyl, naphtyl, tetrahydronaphtyl, indenyl, biphenyl and other similar aromatic radicals. Preferably, phenyl is used. The aryl group may have 1 to 5 substituents such as hydroxy, halo, haloalkyl, nitro, cyano, alkoxy or lower alkylamino.

The aralkyl group, as a substituent for the polymer of Chemical Formula 1, refers to an aryl group of the foregoing with one or more hydrogens substituted with a lower alkyl radical such as methyl, ethyl and propyl. Examples include benzyl and phenylethyl.

The alkylene group, as a substituent for the polymer of Chemical Formula 1, refers to a linear or a branched divalent aliphatic hydrocarbon with 1 to 20 carbon atoms. Preferably, the alkylene group has 1 to 6 carbon atoms. Examples include $—CH_2—$, $—CH_2—CH_2—$ and $—CH_2—CH_2—CH_2—$. One or more hydrogen atom in the alkylene group may be substituted with hydroxy, halogen atom, aryl group and the like.

The heteroalkylene group, as a substituent for the polymer of Chemical Formula 1, refers to an alkylene group of the foregoing with one or more heteroatoms. Examples of the heteroatom include an oxygen atom, a nitrogen atom and a sulfur atom.

The alkenylene group, as a substituent for the polymer of Chemical Formula 1, refers to a linear or branched divalent alkenyl group containing 2 to 20 carbon atoms, which has at least one double bond within the chain. A preferable alkenylene group has 2 to 10 carbon atoms. One or more hydrogen atom in the alkenylene group may be substituted with a hydroxy, a halogen atom, and the like.

The heteroalkenylene group, as a substituent for the polymer of Chemical Formula 1, refers to an alkenylene group of the foregoing with one or more heteroatoms. Examples of the heteroatom include an oxygen atom, a nitrogen atom and a sulfur atom.

The arylene group, as a substituent for the polymer of Chemical Formula 1, refers to a divalent aryl with 6 to 30 carbon atoms. A preferable arylene has 6 to 20 carbon atoms. One or more hydrogen atoms in the arylene group may be substituted with a hydroxy, a halogen atom, a lower alkyl group and the like. Examples include phenylene and napthylene.

A preferable aralkylene group, as a substituent for the polymer of Chemical Formula 1, has 7 to 30 carbon atoms, and more preferably with 7 to 20 carbon atoms. An example is phenylene-methylene.

The invention is further described in detail below. However, the scope of the invention is not limited to the examples below.

EXAMPLE 1

34 g (0.1 mol) of 2,2-methylenebis(6-tert-butyl-p-cresol) was dissolved in 300 ml of chloroform followed by adding 100 g of MnO2 and was refluxed for 12 hours. After the resulting solution was cooled to room temperature, the solution was filtered. By using a rotary evaporator, the solvent of the filtered solution was evaporated and the remains were dissolved in 100 ml of tetrahydrofuran and re-precipitated in 500 ml of methanol to obtain a precipitate. The precipitate was filtered to obtain a reddish solid material. The material was purified by repeating the tetrahydrofuran/methanol precipitation process. After drying, the final resulting material, a polymer represented by Chemical Formula 8 (29 g, 85% yield) was obtained. The PS standard measured by Gel Permeation Chromatography (GPC) was 45, and the average molecular weight was 15,400.

Chemical Formula 8

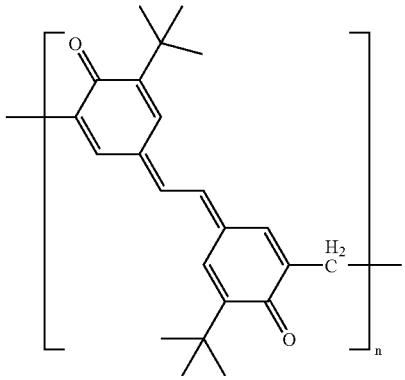

EXAMPLE 2

The composition of a photosensitive layer

| | |
|---|---|
| The charge transporting material obtained in Example 1 | 15 parts by weight |
| Enaminestibene-based hole transporting material of Chemical Formula 37 (as disclosed in U.S. Pat. No. 5,013,623) | 35 parts by weight |
| Gamma-type tytanyl phthalocyanine of Chemical Formula 38 | 8 parts by weight |
| Z type polycarbonate | 60 parts by weight |
| Methylene chloride | 237 parts by weight |
| 1,1,2-trichloroethane | 158 parts by weight |

The above ingredients were mixed together and dissolved in a ball mill, forming a coating mixture. An aluminum drum having a diameter of 30 mm was coated with the coating mixture by ring coating method and dried at 120° C. for 1 hour. A single layered type electrophotographic photoreceptor which had 14 μm of thickness was obtained.

Chemical Formula 37

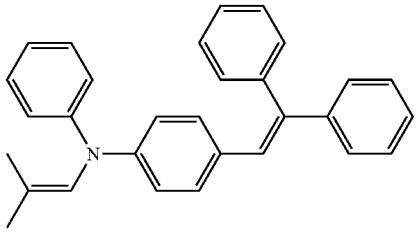

Chemical Formula 38

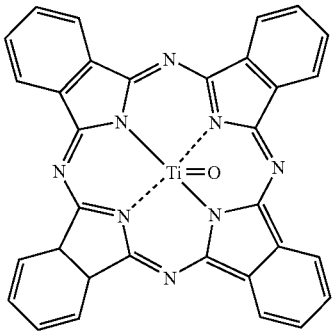

COMPARATIVE EXAMPLE 1

A single layered type electrophotographic photoreceptor was produced by using the same method as Example 2, except that the electron transporting material was not used.

COMPARATIVE EXAMPLE 2

A single layered type of electrophotographic photoreceptor was produced by using the same method as Example 2, except that the stilbenequinone compound represented by Chemical Formula 39 was used as the electron transporting material.

Chemical Formula 39

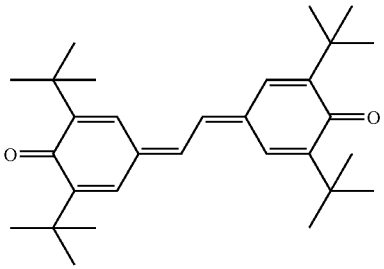

Electrostatic Characteristics

By using a Photoconducting Drum Test System ("PDT-2000" by QEA, INC.), the electrophotographic properties of each of the photoreceptors prepared in the above examples were tested.

The photoreceptors were electrified under the conditions of +7.5 kV of corona voltage for single layered photoreceptors, −7.5 kV for laminated type photoreceptors, and 100 mm/sec of relative velocity of photoreceptors with respect to an electrifier. Then, the surface of the photoreceptors was exposed to 780 nm monochromatic light at a fixed exposure energy between 0 to 1 μJ/cm$^2$. Then the surface potential was determined and recorded. Energy versus surface potential was determined as well. The electrified potential without light exposure is represented by $V_0$(V), and the exposure potential after exposure to light of 1 μJ/cm$^2$ for 0.1 second is represented by $V_r$. Table 1 shows the electric potentials ($V_0$) and exposure potentials ($V_r$) after the first cycle and after 100$^{th}$ cycle.

TABLE 1

| | After the first cycle | | After the 100$^{th}$ Cycle | |
|---|---|---|---|---|
| | $V_0$(V) | $V_r$ | $V_0$(V) | $V_r$ |
| Example 2 | 451 | 88 | 449 | 90 |
| Comparative Example 1 | 455 | 139 | 440 | 148 |
| Comparative Example 2 | 460 | 128 | 423 | 134 |

As Table 1 indicates, Comparative Example 1, which did not use an electron transporting material and Comparative Example 2, which used stilbenquinone as the electron transporting material, showed high exposure potentials. Also, after the 100th cycle, the electrified potentials were lower than after the first cycle, but the exposure potentials were higher. However, the electrical potential and the exposure potential of Example 2 were maintained at the values of the first cycle. The result supports that the photoreceptor using the compound of Chemical Formula 1 as the electron transporting material according to the present invention has enhanced electrostatic properties.

The invention provides a photoreceptor having a polymer having repeating units of stilbenquinone as the electron transporting material. Such a polymer provides improved solubility in a binder resin, thus preventing deposition of crystals even when used in high concentrations and resulting in enhanced electron transportability.

Further, the polymer having repeating units of stilbenquinone is cost effective and provides a high yield because the production process requires a polymerization, using an ordinary oxidation reaction, and thus limits other unwanted side reactions.

FIG. 1 is a block diagram (not to scale) illustrating an electrophotographic photoreceptor 1 comprising a photosensitive layer 2 installed on a conductive substrate 3 in accordance with an embodiment of the present invention.

Figure 2:
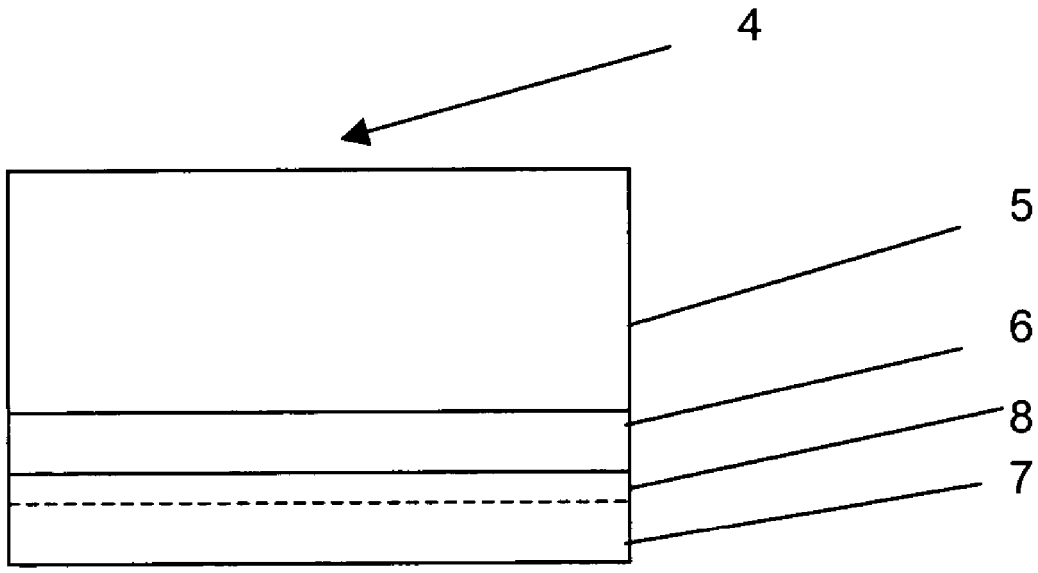
FIG. 2 is a block diagram (not to scale) illustrating an electrophotographic photoreceptor, including a substrate, a photosensitive layer, and an intermediate layer disposed between the substrate and the photosensitive layer, and where selected, where the intermediate layer is a conductive layer, further including a barrier layer formed between the conductive layer and the substrate, in accordance with an embodiment of the present invention.

FIG. 2 is a block diagram (not to scale) illustrating an electrophotographic photoreceptor 4, including a substrate 7, a photosensitive layer 5, and an intermediate layer 6 disposed between the substrate 7 and the photosensitive layer 5 in accordance with an embodiment of the present invention. The intermediate layer 6 is typically a conductive layer or a barrier layer, as described more fully above. Where the intermediate layer 6 is a conductive layer, where desired, a barrier layer 8 may be formed between the substrate 7 and the intermediate layer 6.

Figure 3:
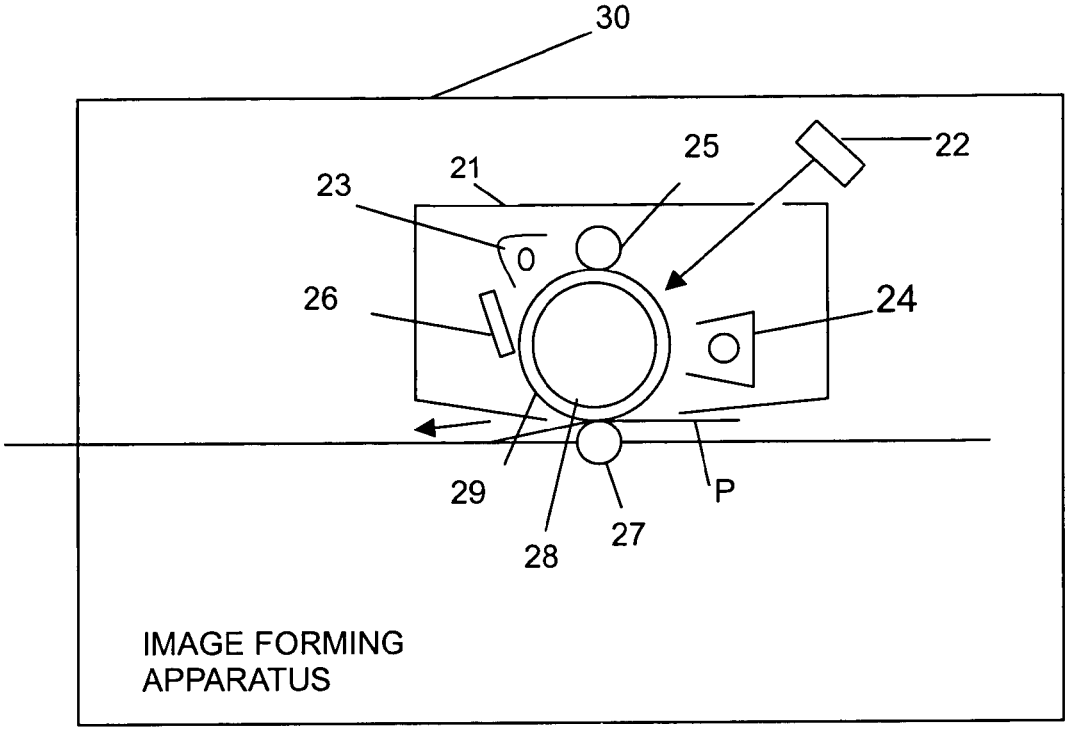
FIG. 3 is a schematic representation of an image forming apparatus, an electrophotgraphic drum, and an electrophographic cartridge in accordance with selected embodiments of the present invention.

FIG. 3 is a schematic representation of an image forming apparatus 30, an electrophotgraphic drum 28, and an electrophographic cartridge 29 in accordance with selected embodiments of the present invention. The electrophotographic cartridge 29 typically comprises an electrophotographic photoreceptor 29 and at least one of a charging device 25 that charges the electrophotographic photoreceptor 29, a developing device 24 which develops an electrostatic latent image formed on the electrophotographic photoreceptor 29, and a cleaning device 26 which cleans a surface of the electrophotographic photoreceptor 29. The electrophotographic cartridge 21 may be attached to or detached from the image forming apparatus 30, and the electrophotographic photoreceptor 29 is described more fully above.

The electrophotographic photoreceptor drum 28, 29 for an image forming apparatus 30, generally includes a drum 28 that is attachable to and detachable from the electrophotographic apparatus 30 and that includes an electrophotographic photoreceptor 29 disposed on the drum 28, wherein the electrophotographic photoreceptor 29 is described more fully above.

Generally, the image forming apparatus 30 includes a photoreceptor unit (e.g., an electrophotographic photoreceptor drum 28, 29), a charging device 25 which charges the photoreceptor unit, an imagewise light irradiating device 22 which irradiates the charged photoreceptor unit with imagewise light to form an electrostatic latent image on the photoreceptor unit, a developing unit 24 that develops the electrostatic latent image with a toner to form a toner image on the photoreceptor unit, and a transfer device 27 which transfers the toner image onto a receiving material, such as paper P, wherein the photoreceptor unit comprises an electrophotographic photoreceptor 29 as described in greater detail above. The charging device 25 may be supplied with a voltage as a charging unit and may contact and charge the electrophotographic receptor. Where desired, the apparatus may include a pre-exposure unit 23 to erase residual charge on the surface of the electrophotographic photoreceptor to prepare for a next cycle.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A polymer represented by the following chemical formula 1:

Chemical Formula 1

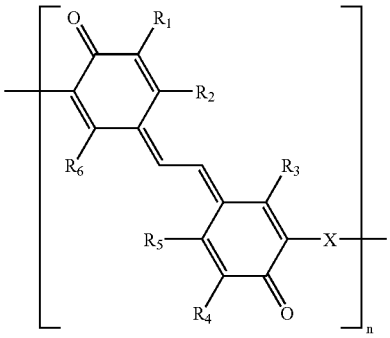

wherein $R_1$, $R_2$, $R_3$, $R_4$, $R_5$, and $R_6$ each independently is selected from the group consisting of a hydrogen atom, a halogen atom, a hydroxy group, a carboxyl group, a cyano group, an amino group, a nitro group, an optionally substituted alkyl group with 1 to 20 carbon atoms, an optionally substituted aryl group with 6 to 30 carbon atoms, an optionally substituted arylalkyl group with 7 to 30 carbon atoms, and an optionally substituted alkoxy group with 1 to 20 carbon atoms; —X— represents a single bond, —S—, —O—, —NH—, an optionally substituted alkylene group with 1 to 20 carbon atoms, an optionally substituted heteroalkylene group with 1 to 20 carbon atoms, an optionally substituted alkenylene group with 2 to 20 carbon atoms, an optionally substituted heteroalkenylene group with 2 to 20 carbon atoms, an optionally substituted arylene group with 6 to 30 carbon atoms, and an optionally substituted arylalkylene group with 7 to 30 carbon atoms; and n represents an integer of 5 to 1,000.

2. The polymer of claim 1, wherein an average molecular weight of the polymer is 500 to 100,000.

3. An electrophotographic photoreceptor comprising an electroconductive substrate and a photosensitive layer formed thereon, the photosensitive layer comprising the polymer of claim 1.

4. The electrophotographic photoreceptor of claim 3, wherein the electrophotographic photoreceptor is utilized in one of: a copy machine, a laser printer, a CRT printer, an LED printer, a liquid crystal printer, and a laser electronic photographer.

5. An electrophotographic photoreceptor comprising an electroconductive substrate, an intermediate layer formed thereon, and a photosensitive layer formed on the intermediate layer, the photosensitive layer containing the polymer of claim 1.

6. The electrophotographic photoreceptor of claim 5 wherein the intermediate layer is a conductive layer.

7. The electrophotographic photoreceptor of claim 6, wherein the conductive layer is one of: carbon black, graphite, a metal powder and a metal oxide.

8. The electrophotographic photoreceptor of claim 5, wherein the intermediate layer is a barrier layer.

9. The electrophotographic photoreceptor of claim 8, wherein the barrier layer is one of: an anodized surface layer of aluminum, a layer of a resin, and a layer of a mixture containing the resin and at least one metallic oxide powder.

10. The electrophotographic photoreceptor of claim 9, wherein the metallic oxide powder is one of: titanium oxide powder and tin oxide powder.

11. The electrophotographic photoreceptor of claim 10, wherein the resin is one of: polyvinyl alcohol, casein, ethyl cellulose, gelatin, phenol resin and a polyamide.

12. The electrophotographic photoreceptor of claim 5, wherein the polymer of Chemical Formula 1 functions as a charge/electron transporting material and is located in one of:

a charge transporting layer of a laminated type photosensitive layer that includes a further layer comprising a charge generating material; and a single layer, combined with the charge generating material, of a single layered type photosensitive layer.

13. The electrophotographic photoreceptor of claim 12, wherein the charge generating material comprises at least one of, alone or in combination: a pthalocyanine pigment, an azo pigment, a quinone pigment, a perylene pigment, an indigo pigment, a bisbenzoimidazole pigment, a quinacridone pigment, an azulenium dye, a squarilium dye, a pyrylium dye, a triarylmethane dye, a cyanine dye, amorphous silicon, amorphous selenium, trigonal selenium, tellurium, a selenium-tellurium alloy, cadmium sulphide, antimony sulfide, and zinc sulfide.

14. The electrophotographic photoreceptor of claim 13, wherein, in a laminated type photosensitive layer, the charge generating material is dissolved in a solvent with a binder resin to form a film on an electroconductive substrate by one of: coating, vacuum deposition, sputtering and chemical vapor deposition (CVD) to form a charge generating layer.

15. The electrophotographic photoreceptor of claim 14, wherein the binder resin is an electrically insulating polymer.

16. The electrophotographic photoreceptor of claim 15, wherein the binder resin is at least one of, alone or in combination: polycarbonate, polyester, methacrylic resin, acryl resin, polyvinylchloride, polyvinylidene chloride, polystyrene, polyvinylacetate, silicon resin, silicon-alkyd resin, styrene-alkyd resin, poly-N-vinylcarbazole, phenoxy resin, epoxy resin, polyvinyl butyral, polyvinyl acetal, polyvinyl formal, polysulfone, polyvinyl alcohol, ethylcellulose, phenol resin, polyamide, carboxymethyl cellulose and polyurethane.

17. The electrophotographic photoreceptor of claim 14, wherein a ratio of the charge transporting material and the binding resin is approximately 1:0.5 to 1:2.

18. The electrophotographic photoreceptor of claim 14, wherein at least one of: a plasticizer, a leveling agent, a dispersing stabilizer, an antioxidant and a photostabilizer is added with the binder resin.

19. The electrophotographic photoreceptor of claim 18, wherein the antioxidant is derived from one of: phenols, sulfurs, phosphors and amines.

20. The electrophotographic photoreceptor of claim 18, wherein the photostabilizer comprises at least one of, alone or in combination: a benzotriazole compound, a benzophenone compound and a hindered amine compound.

21. The electrophotographic photoreceptor of claim 12, wherein the polymer of Chemical Formula 1 functions as a charge/electron transporting material and is located in a charge transporting layer of a laminated type photosensitive layer that includes a further layer comprising a charge generating material, wherein, in forming the laminated type photosensitive layer, one of:

the charge transporting layer having the polymer of Chemical Formula 1 is formed on the charge generating layer; and the charge generating layer is formed on the charge transporting layer having the polymer of Chemical Formula 1.

22. The electrophotographic photoreceptor of claim 12, wherein the polymer of Chemical Formula 1 functions as a charge/electron transporting material and is located in a single layer, combined with the charge generating material, of a single layered type photosensitive layer, the single layered type photosensitive layer is made from a solution containing a charge generating material, a charge transporting material, a binder resin and a solvent.

23. The electrophotographic photoreceptor of claim 12, wherein the polymer of Chemical Formula 1 functions as a charge/electron transporting material and is combined with at least one other charge transporting material that is one of: a hole transporting material and an electron transporting material for a single layered type photoreceptor.

24. The electrophotographic photoreceptor of claim 23, wherein the hole transporting material is at least one of: a nitrogen containing cyclic compound and a condensed polycyclic compound selected from the group consisting of pyrenes, hydrazones, oxazoles, oxadiazoles, pyrazolines, arylamines, arylmethanes, benzidines, tiazoles, styryls, polymer compounds having the foregoing substituents in a main chain or a side chain, and polysilanes having the foregoing substituents in a main chain or a side chain.

25. The electrophotographic photoreceptor of claim 23, wherein the electron transporting material comprises at least one of, alone or in combination: a benzoquinone, a cyanoethylene, a cyanoquinodimethanes, a fluorenone, a xanthone, a phenanthraquinone, a phthalic acid anhydride, a thiopyran and a diphenoquinone.

26. The electrophotographic photoreceptor of claim 23, wherein the electron transporting material is an electron transporting polymer or pigment with n-type semiconductor characteristics.

27. The electrophotographic photoreceptor of claim 12, wherein a thickness of the photosensitive layer is approximately 5 μm to 50 μm for both the single layered type and the laminated type photosensitive layers.

28. A process for preparing a polymer of chemical formula 1 below, which comprises refluxing methylenebisphenol in an organic solvent and in the presence of an oxidizing agent for 5 to 48 hours:

Chemical Formula 1

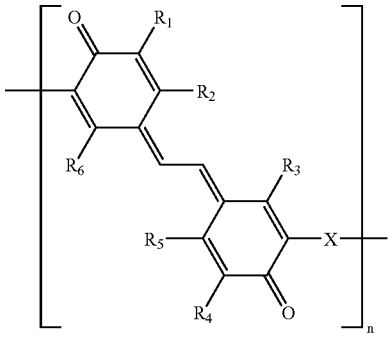

wherein $R_1$, $R_2$, $R_3$, $R_4$, $R_5$, and $R_6$ each independently is selected from the group consisting of a hydrogen atom, a halogen atom, a hydroxy group, a carboxyl group, a cyano group, an amino group, a nitro group, an optionally substituted alkyl group with 1 to 20 carbon atoms, an optionally substituted aryl group with 6 to 30 carbon atoms, an optionally substituted arylalkyl group with 7 to 30 carbon atoms, and an optionally substituted alkoxy group with 1 to 20 carbon atoms; —X— represents a single bond, —S—, —O—, —NH—, an optionally substituted alkylene group with 1 to 20 carbon atoms, an optionally substituted heteroalkylene group with 1 to 20 carbon atoms, an optionally substituted alkenylene group with 2 to 20 carbon atoms, an optionally substituted heteroalkenylene group with 2 to 20 carbon atoms, an optionally substituted arylene group with 6 to 30 carbon atoms, and an optionally substituted arylalkylene group with 7 to 30 carbon atoms; and n represents an integer of 5 to 1,000.

29. The process of claim 28, wherein the oxidizing agent is one of manganese dioxide, chromic acid and permanganic acid.

30. The process of claim 28, wherein the organic solvent is a halogenated solvent.

31. The process of claim 30, wherein the halogenated solvent is one of: chloroform, dichloromethane, and dichloroethane.

32. The polymer of claim 28, wherein the average molecular weight of the polymer of Chemical Formula 1 is 100 to 100,000.

33. The polymer of claim 1, wherein the polymer of Chemical Formula 1 is one of:

Chemical Formula 2

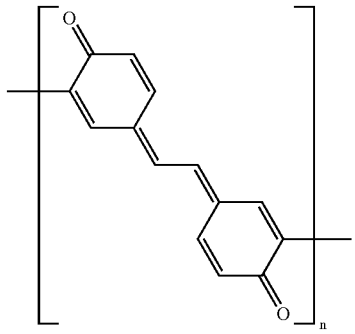

Chemical Formula 3

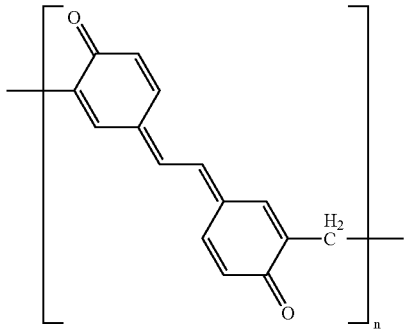

Chemical Formula 4

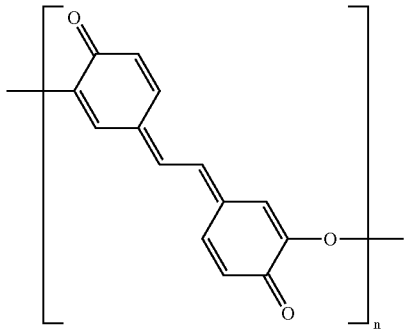

Chemical Formula 5

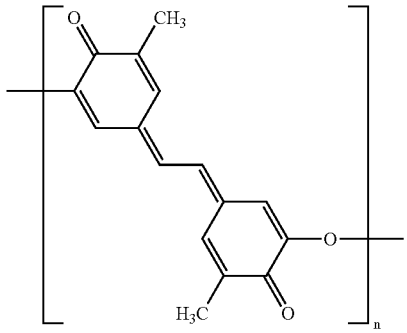

-continued
Chemical Formula 7
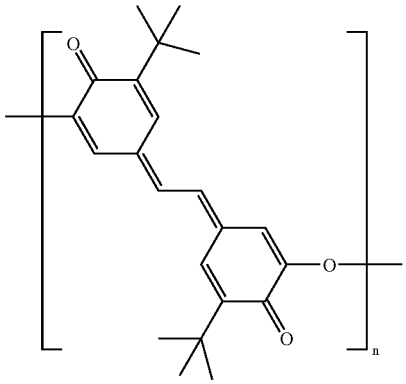
Chemical Formula 8
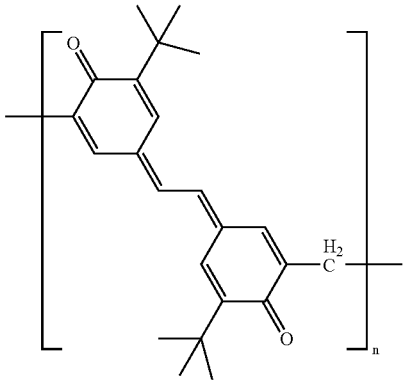
Chemical Formula 9
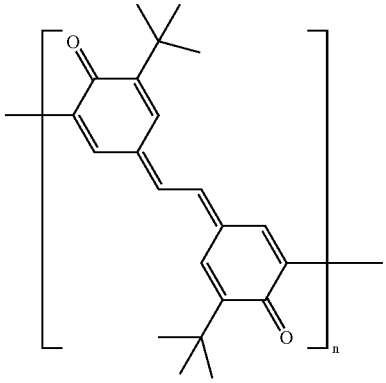
Chemical Formula 10
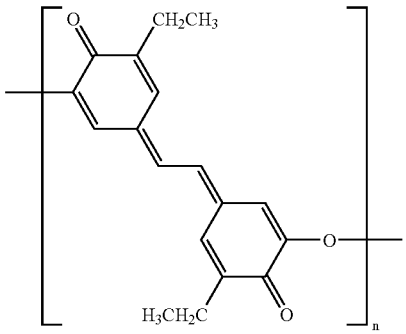
-continued
Chemical Formula 11
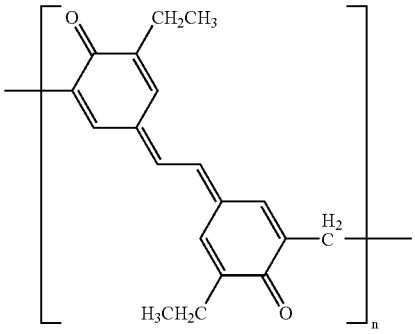
Chemical Formula 12
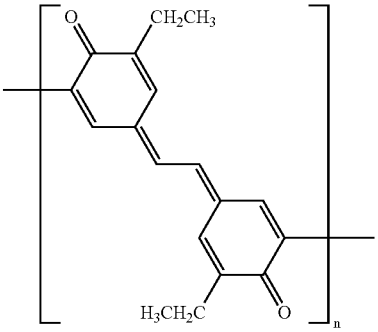
Chemical Formula 13
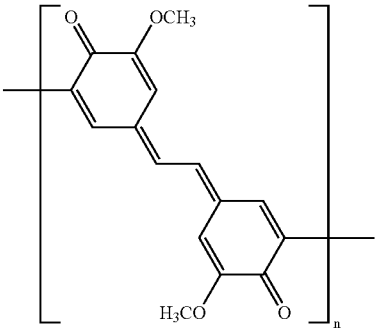
Chemical Formula 14
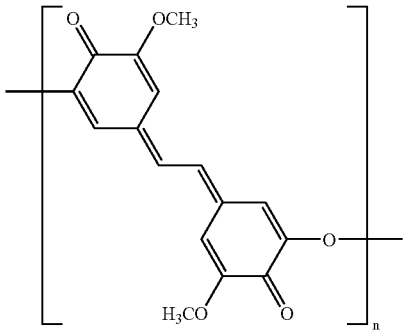

-continued
Chemical Formula 15
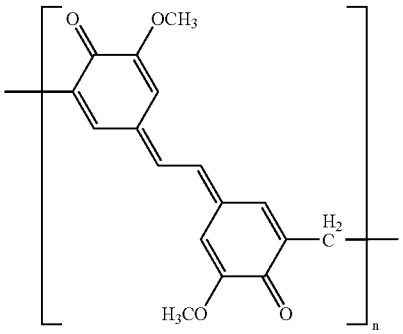
Chemical Formula 16
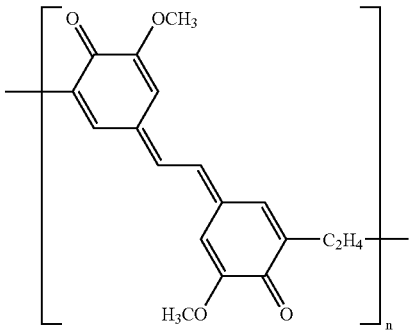
Chemical Formula 17
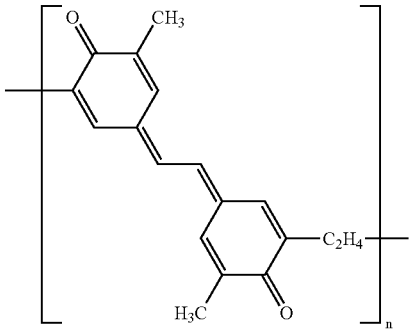
Chemical Formula 18
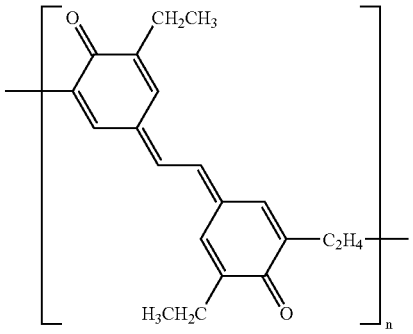
-continued
Chemical Formula 19
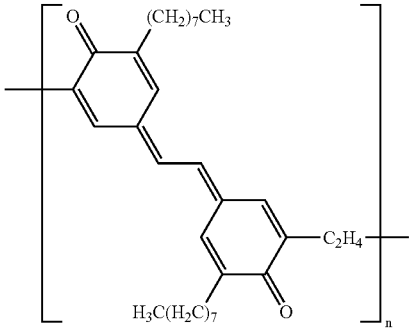
Chemical Formula 20
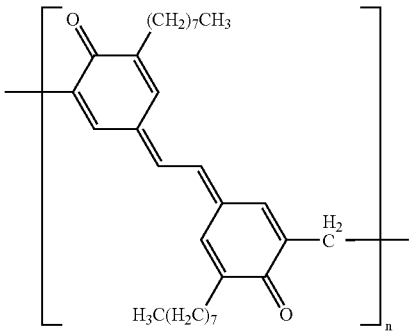
Chemical Formula 21
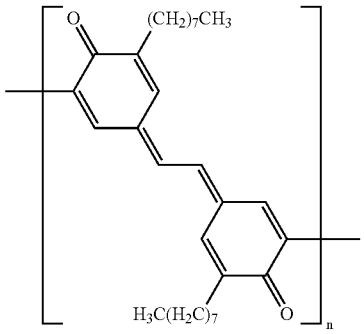
Chemical Formula 22
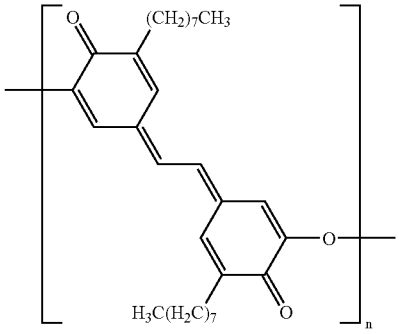

-continued
Chemical Formula 23
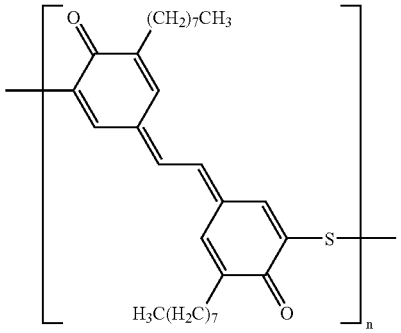
Chemical Formula 24
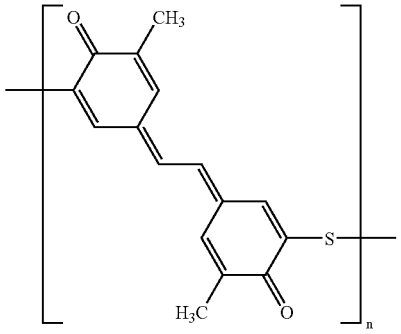
Chemical Formula 25
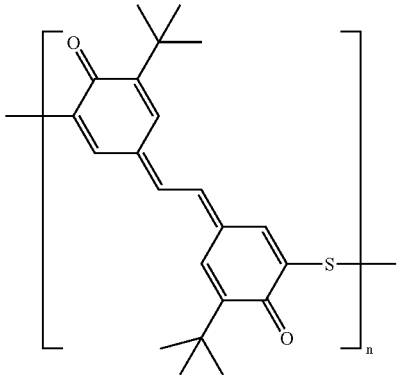
Chemical Formula 26
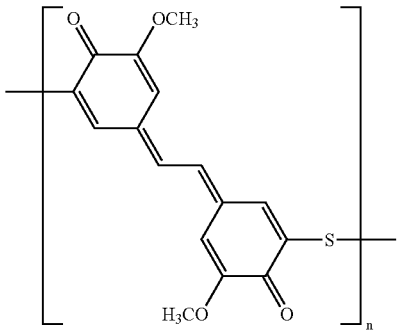
-continued
Chemical Formula 27
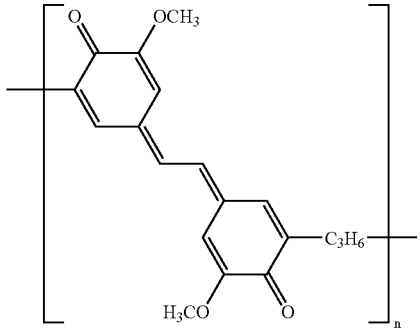
Chemical Formula 28
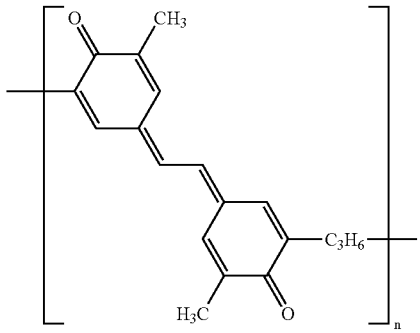
Chemical Formula 29
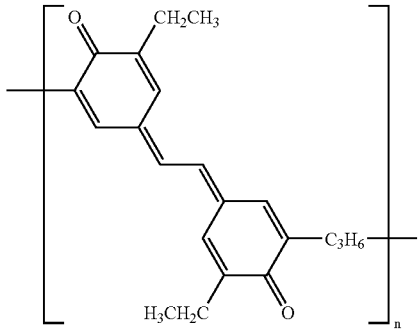
Chemical Formula 30
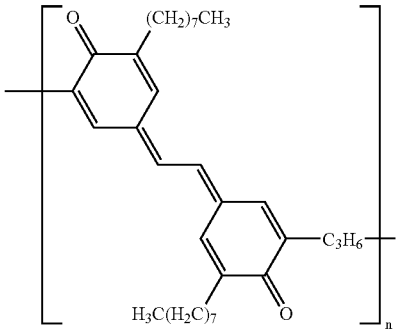

-continued

Chemical Formula 31

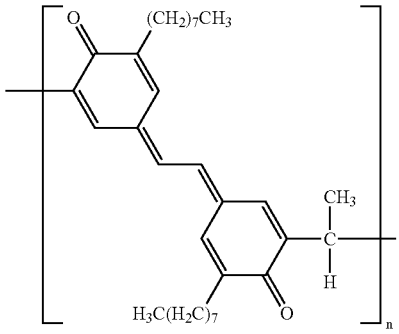

Chemical Formula 32

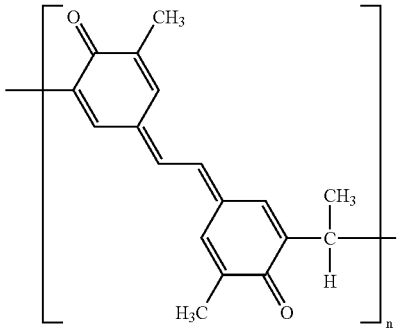

Chemical Formula 33

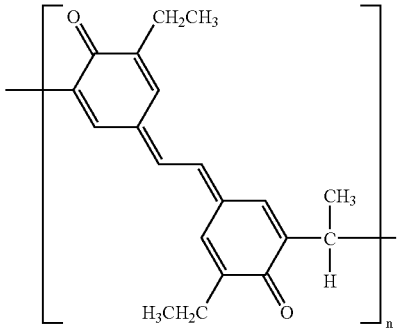

Chemical Formula 34

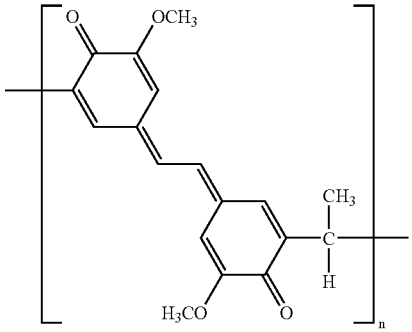

-continued

Chemical Formula 35

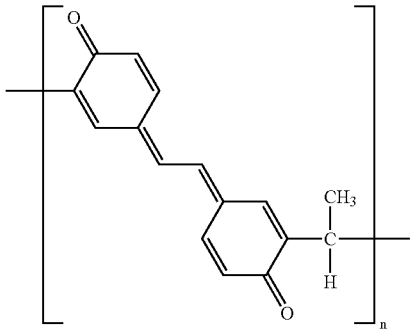

Chemical Formula 36

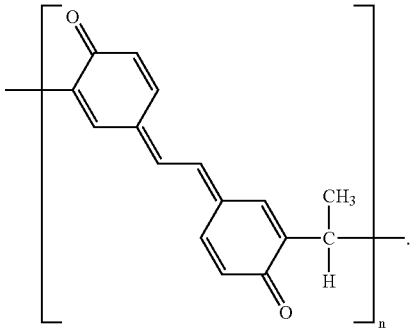

34. The polymer of claim 1, wherein the alkyl group, as a substituent for the polymer of Chemical Formula 1, is a linear or a branched radical with 1 to 12 carbon atoms.

35. The polymer of claim 34, wherein the alkyl group, as a substituent for the polymer of Chemical Formula 1, is a linear or a branched radical with 1 to 8 carbon atoms.

36. The polymer of claim 1, wherein the alkoxy group, as a substituent for the polymer of Chemical Formula 1, is a linear or a branched, oxygen-containing radical with alkyl moiety having 1 to 20 carbon atoms.

37. The polymer of claim 36, wherein the alkoxy group is a lower alkoxy radical with 1 to 6 carbon atoms.

38. The polymer of claim 37, wherein the alkoxy group is a lower haloalkoxy radical with 1 to 3 carbon atoms.

39. The polymer of claim 1, wherein the aryl group, as a substituent for the polymer of Chemical Formula 1, is a cyclic aromatic hydrocarbon with 6 to 30 carbon atoms in at least one ring structure, and may be used solely or in a combination, wherein a plurality of rings is held together by one of: a pendant method and fusing together, and the term "aryl" includes aromatic radicals.

40. The polymer of claim 1, wherein the aryl group, as a substituent for the polymer of Chemical Formula 1, is a cyclic aromatic hydrocarbon with 6 to 30 carbon atoms in at least one ring structure, and may be used solely or in a combination, wherein a plurality of rings is held together by one of: a pendant method and fusing together, and the term "aryl" includes phenyl having 1 to 5 substituents selected from the group consisting of hydroxy, halo, haloalkyl, nitro, cyano, alkoxy and lower alkylamino.

41. The polymer of claim 1, wherein the aralkyl group, as a substituent for the polymer of Chemical Formula 1, is an aryl group with one or more hydrogens substituted with a lower alkyl radical.

42. The polymer of claim 1, wherein the alkylene group, as a substituent for the polymer of Chemical Formula 1, is a linear or a branched divalent aliphatic hydrocarbon with 1 to 20 carbon atoms.

43. The polymer of claim 1, wherein the alkylene group, as a substituent for the polymer of Chemical Formula 1, is a linear or a branched divalent aliphatic hydrocarbon with 1 to 6 carbon atoms.

44. The polymer of claim 1, wherein the heteroalkylene group, as a substituent for the polymer of Chemical Formula 1, is an alkylene group with one or more heteroatoms.

45. The polymer of claim 1, wherein the alkenylene group, as a substituent for the polymer of Chemical Formula 1, is a linear or branched divalent alkenyl group containing 2 to 20 carbon atoms, which has at least one double bond within the chain.

46. The polymer of claim 1, wherein the alkenylene group, as a substituent for the polymer of Chemical Formula 1, is a linear or branched divalent alkenyl group containing 2 to 10 carbon atoms, wherein, where desired, one or more hydrogen atom in the alkenylene group is substituted with a hydroxy, or a halogen atom.

47. The polymer of claim 1, wherein the heteroalkenylene group, as a substituent for the polymer of Chemical Formula 1, is an alkenylene group with one or more heteroatoms.

48. The polymer of claim 1, wherein the arylene group, as a substituent for the polymer of Chemical Formula 1, is a divalent aryl with 6 to 30 carbon atoms.

49. The polymer of claim 1, wherein the arylene group, as a substituent for the polymer of Chemical Formula 1, is a divalent aryl with 6 to 20 carbon atoms, wherein, where desired, one or more hydrogen atoms in the arylene group is substituted with a hydroxy, a halogen atom, or a lower alkyl group.

50. The polymer of claim 1, wherein the aralkylene group, as a substituent for the polymer of Chemical Formula 1, has 7 to 30 carbon atoms.

51. The polymer of claim 1, wherein the aralkylene group, as a substituent for the polymer of Chemical Formula 1, has 7 to 20 carbon atoms.

52. An electrophotographic cartridge, comprising:

an electrophotographic photoreceptor comprising a photosensitive layer having at least a charge generating material, a charge transport material and a binder on a conductive support, wherein the charge transport material comprises a polymer represented by the following chemical formula 1:

Chemical Formula 1

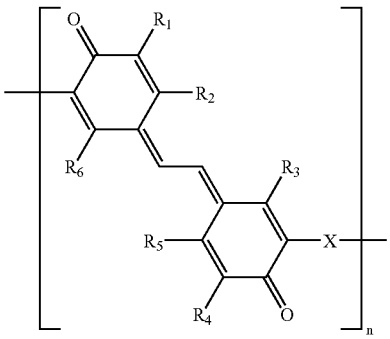

wherein $R_1$, $R_2$, $R_3$, $R_4$, $R_5$, and $R_6$ each independently is selected from the group consisting of a hydrogen atom, a halogen atom, a hydroxy group, a carboxyl group, a cyano group, an amino group, a nitro group, an optionally substituted alkyl group with 1 to 20 carbon atoms, an optionally substituted aryl group with 6 to 30 carbon atoms, an optionally substituted arylalkyl group with 7 to 30 carbon atoms, and an optionally substituted alkoxy group with 1 to 20 carbon atoms; —X— represents a single bond, —S—, —O—, —NH—, an optionally substituted alkylene group with 1 to 20 carbon atoms, an optionally substituted heteroalkylene group with 1 to 20 carbon atoms, an optionally substituted alkenylene group with 2 to 20 carbon atoms, an optionally substituted heteroalkenylene group with 2 to 20 carbon atoms, an optionally substituted arylene group with 6 to 30 carbon atoms, and an optionally substituted arylalkylene group with 7 to 30 carbon atoms; and n represents an integer of 5 to 1,000; and at least one of:

a charging device that charges the electrophotographic photoreceptor;

a developing device which develops an electrostatic latent image formed on the electrophotographic photoreceptor; and a cleaning device which cleans a surface of the electrophotographic photoreceptor, wherein the electrophotographic cartridge is attachable to/detachable from an image forming apparatus.

53. An electrophotographic drum, comprising:

a drum that is attachable to and detachable from an electrophotographic apparatus; and an electrophotographic photoreceptor, disposed on the drum, the single layered electrophotographic photoreceptor comprising:

a photosensitive layer having at least a charge generating material, a charge transport material and a binder on a conductive support, wherein the charge transport material comprises a polymer represented by the following chemical formula 1:

Chemical Formula 1

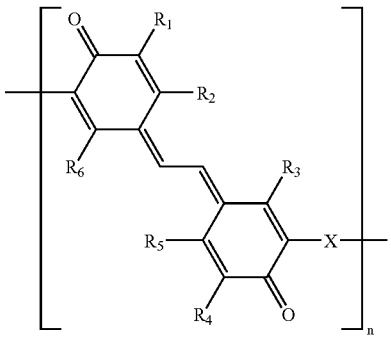

wherein $R_1$, $R_2$, $R_3$, $R_4$, $R_5$, and $R_6$ each independently is selected from the group consisting of a hydrogen atom, a halogen atom, a hydroxy group, a carboxyl group, a cyano group, an amino group, a nitro group, an optionally substituted alkyl group with 1 to 20 carbon atoms, an optionally substituted aryl group with 6 to 30 carbon atoms, an optionally substituted arylalkyl group with 7 to 30 carbon atoms, and an optionally substituted alkoxy group with 1 to 20 carbon atoms; —X— represents a single bond, —S—, —O—, —NH—, an optionally substituted alkylene group with 1 to 20 carbon atoms, an optionally substituted heteroalkylene group with 1 to 20 carbon atoms, an optionally substituted alkenylene group with 2 to 20 carbon atoms, an optionally substituted heteroalkenylene group with 2 to 20 carbon atoms, an optionally substituted arylene group with 6 to 30 carbon atoms, and an optionally substituted arylalkylene group with 7 to 30 carbon atoms; and n represents an integer of 5 to 1,000.

54. An image forming apparatus comprising:

a photoreceptor unit comprising:

an electrophotographic photoreceptor comprising:

a photosensitive layer having at least a charge generating material, a charge transport material and a binder on a conductive support, wherein the charge transport material comprises a polymer represented by the following chemical formula 1:

Chemical formula 1

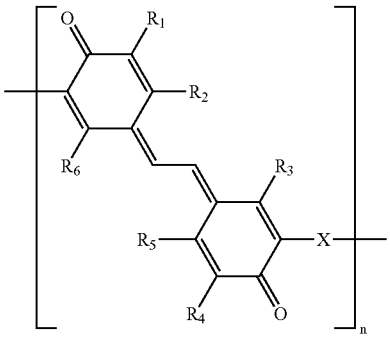

wherein $R_1$, $R_2$, $R_3$, $R_4$, $R_5$, and $R_6$ each independently is selected from the group consisting of a hydrogen atom, a halogen atom, a hydroxy group, a carboxyl group, a cyano group, an amino group, a nitro group, an optionally substituted alkyl group with 1 to 20 carbon atoms, an optionally substituted aryl group with 6 to 30 carbon atoms, an optionally substituted arylalkyl group with 7 to 30 carbon atoms, and an optionally substituted alkoxy group with 1 to 20 carbon atoms; —X— represents a single bond, —S—, —O—, —NH—, an optionally substituted alkylene group with 1 to 20 carbon atoms, an optionally substituted heteroalkylene group with 1 to 20 carbon atoms, an optionally substituted alkenylene group with 2 to 20 carbon atoms, an optionally substituted heteroalkenylene group with 2 to 20 carbon atoms, an optionally substituted arylene group with 6 to 30 carbon atoms, and an optionally substituted arylalkylene group with 7 to 30 carbon atoms; and n represents an integer of 5 to 1,000;

a charging device which charges the photoreceptor unit;

an imagewise light irradiating device which irradiates the charged photoreceptor unit with imagewise light to form an electrostatic latent image on the photoreceptor unit;

a developing unit that develops the electrostatic latent image with a toner to form a toner image on the photoreceptor unit; and a transfer device which transfers the toner image onto a receiving material.

* * * * *